US005968721A

United States Patent [19]

Twist

[11] Patent Number: 5,968,721

[45] Date of Patent: Oct. 19, 1999

[54] PHOTOGRAPHIC DEVELOPER/AMPLIFIER PROCESS AND SOLUTIONS

[75] Inventor: Peter J. Twist, Gt. Missenden, United Kingdom

[73] Assignee: Eastman Kodak Company, Rochester, N.Y.

[21] Appl. No.: 08/969,325

[22] Filed: Nov. 13, 1997

[30] Foreign Application Priority Data

Nov. 13, 1996 [GB] United Kingdom ..... 9623564

[51] Int. Cl.[6] ..... G03C 7/413

[52] U.S. Cl. ..... 430/490; 430/373; 430/414; 430/943

[58] Field of Search ..... 430/464, 490, 430/943, 373, 414

[56] References Cited

U.S. PATENT DOCUMENTS

| | | | |
|---|---|---|---|
| 4,170,478 | 10/1979 | Case et al. | 430/357 |
| 4,876,174 | 10/1989 | Ishikawa et al. | 430/990 |
| 5,324,624 | 6/1994 | Twist | 430/943 |
| 5,354,646 | 10/1994 | Kobayashi et al. | 430/490 |
| 5,358,830 | 10/1994 | Twist | 430/943 |
| 5,387,499 | 2/1995 | Earle et al. | 430/943 |
| 5,418,117 | 5/1995 | Marsden | 430/943 |
| 5,439,784 | 8/1995 | Grimsey et al. | 430/943 |
| 5,547,816 | 8/1996 | Fyson et al. | 430/943 |
| 5,667,947 | 9/1997 | Twist | 430/943 |
| 5,670,300 | 9/1997 | Fyson et al. | 430/943 |
| 5,738,980 | 4/1998 | Twist et al. | 430/943 |
| 5,766,831 | 6/1998 | Wildman | 430/943 |

FOREIGN PATENT DOCUMENTS

| | | |
|---|---|---|
| 0 410 375 | 1/1991 | European Pat. Off. . |
| 0 636 933 A1 | 2/1995 | European Pat. Off. . |
| 0654 707 A1 | 5/1995 | European Pat. Off. . |
| 91/12567 | 8/1991 | WIPO . |

*Primary Examiner*—Hoa Van Le
*Attorney, Agent, or Firm*—J. Lanny Tucker

[57] ABSTRACT

A process for the redox development of an imagewise exposed photographic recording material comprises developing the photographic material in a redox developer/amplifier solution containing peroxide as an oxidizing agent, hydroxylamine as an antioxidant, and to improve the stability of the solution under aeration conditions, an effective amount of a mono or di-N-substituted hydroxylamine. The molar ratio of hydroxylamine to N-substituted hydroxylamine may be from 1:200 to 100:1. The substituents in the mono- or di-N-substituted hydroxylamine may be substituted or unsubstituted monovalent organic groups having 1 to 12 carbon atoms.

14 Claims, No Drawings

PHOTOGRAPHIC DEVELOPER/AMPLIFIER PROCESS AND SOLUTIONS

FIELD OF THE INVENTION

This invention relates to a redox development process and to developer/amplifier solutions for use in the process.

BACKGROUND OF THE INVENTION

Redox amplification processes have been described, for example in British Specifications Nos. 1,268,126; 1,399,481; 1,403,418; and 1,560,572. In such processes color materials are developed to produce a silver image (which may contain only small amounts of silver) and treated with a redox amplifying solution (or a combined developer/amplifier) to form a dye image.

The developer/amplifier solution contains a color developing agent and an oxidizing agent that will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds which provide hydrogen peroxide, e.g., addition compounds of hydrogen peroxide such as perborates and addition compounds of hydrogen peroxide with urea. Other oxidizing agents include cobalt (III) complexes including cobalt hexammine complexes; and periodates. Mixtures of such compounds can also be used.

Developer/amplifier solutions are known to deteriorate because they contain both an oxidizing agent (e.g., the peroxide) and a reducing agent (the color developing agent) which react together spontaneously thus leading to loss of activity in a matter of an hour or two.

By contrast conventional photographic color developer solutions which lose activity by aerial oxidation of the color developing agent, typically will be stable for a week or two. In order to reduce oxidation losses, hydroxylamine and its substituted derivatives such as diethylhydroxylamine have been proposed as anti-oxidants for color developer solutions.

Redox developer amplifiers containing hydroxylamine as the antioxidant have been previously shown to be more stable than those containing diethyl hydroxylamine or similar substituted hydroxylamines. However, it has recently been discovered that hydroxylamine in made up developer-replenisher is prone to aerial oxidation. This can lead to variable levels of hydroxylamine in the redox developer and variable sensitometry in the paper print and can be a significant problem in processes that are run under high oxidation conditions such as those in processing machines with partially submerged rollers and with continuous recirculation of developer solution.

SUMMARY OF THE INVENTION

According to the present invention there is provided a developer/amplifier solution for use in redox development comprising:

a color developing agent, as oxidizing agent, hydrogen peroxide or a compound which provides hydrogen peroxide, hydroxylamine or salt thereof, and an effective amount of a mono- or di-N-substituted hydroxylamine as a solution stabilizer.

The invention also provides a process for the redox development of an imagewise exposed photographic recording material, the process comprising developing the photographic recording material with a redox developer/amplifier solution for use in redox development comprising:

a color developing agent, as oxidizing agent, hydrogen peroxide or a compound which provides hydrogen peroxide, hydroxylamine or salt thereof, and an effective amount of a mono- or di-N-substituted hydroxylamine as a solution stabilizer.

The invention further provides a low volume developer tank for use in redox development, the tank containing a redox developer/amplifier solution which comprises:

a color developing agent, hydrogen peroxide or a compound which provides hydrogen peroxide, hydroxylamine, or salt thereof, and a mono- or di-substituted hydroxylamine, wherein hydrogen peroxide is present at from 0.5 to 20 ml/l (as 30% w/w aqueous solution), hydroxylamine or a salt thereof is present at from 0.1 g/l to 10 g/l (as hydroxylamine sulfate), and the mono- or di-N-substituted hydroxylamine is present at from 0.001 to 0.2 molar, and wherein the pH is in the range from 10.5 to 12.5.

Contrary to expectation, it has now been found that, for processes run under aeration, especially high aeration conditions, developer solutions containing both hydroxylamine and an N-substituted hydroxylamine have improved stability as compared to hydroxylamine alone.

The present invention therefore provides a solution to the problem noted above by the provision of a developer/amplifier solution containing both hydroxylamine and an N-substituted hydroxylamine.

The RX developer/amplifier solutions containing the combination of hydroxylamine and an N-substituted hydroxylamine have a useful lifetime which is greater than those containing hydroxylamine alone and are especially suitable for use under conditions of high aeration and especially in low volume thin development tanks.

DETAILED DESCRIPTION OF THE INVENTION

Preferably the molar ratio of hydroxylamine to the N-substituted hydroxylamine is from 1:200 to 100:1, more preferably from 1:10 to 10:1, and most preferably from 1:2 to 5:1.

Preferred concentration ranges are from 0.1 to 10 g/l of hydroxylamine sulfate and from 0.01 ml/l to 20 ml/l (as 80% solution) of the N-substituted hydroxylamine.

The hydroxylamine may be a salt thereof such as hydroxylamine chloride, phosphate or, preferably, sulfate.

The N-substituted hydroxylamine may be mono or disubstituted, however disubstituted compounds are preferred.

Suitable substituents are monovalent organic groups containing not more than 12 carbon atoms. Suitable groups are alkyl or aryl groups which may be substituted for example with sulfo, hydroxy, carboxy, carbonamido or sulfonamido.

Substituted or unsubstituted lower alkyl groups containing from 1 to 6 carbon atoms are particularly suitable.

Conveniently, one substituted hydroxylamine will be used although it is possible to use a mixture of different N-substituted hydroxylamines.

The pH of the developer/amplifier solution is preferably buffered, e.g., by a phosphate such as potassium hydrogen phosphate ($K_2HPO_4$) or by another phosphate, carbonate, silicate or mixture thereof.

Conveniently, the redox developer/amplifier solution of the present invention comprises a color developing agent, hydrogen peroxide or a compound which provides hydrogen peroxide and hydroxylamine or a salt thereof, wherein the concentration ranges are:

hydrogen peroxide from about 0.1 to about 20 ml/l, preferably about 0.5 to about 15 ml/l (as 30% w/w solution), hydroxylamine or a salt thereof from about 0.1 to about 10.0 g/l, preferably about 0.25 to about 8 g/l (as hydroxylamine sulfate), and wherein the pH is in the range from about 10.5 to about 12.5.

The color developing agent may be any of those known in the art, for example, the p-phenylene diamines, e.g.:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethyl aniline hydrochloride and 4-amino-N-ethyl-N-(2-methoxyethyl)-m-toluidene di-p-toluene sulfonic acid.

The concentration range of the hydrogen peroxide is more preferably from about 0.5 to about 7 ml/l and especially from about 0.5 to about 3 ml/l (as 30% w/w solution).

The concentration range of the hydroxylamine component is from about 0.5 to about 4 and especially from about 0.5 to about 2 g/l.

The pH is preferably in the range about 11 to about 11.7 and especially from about 11 to about 11.4.

The composition is preferably free of any compound that forms a dye on reaction with oxidized color developer.

The relative proportions of hydrogen peroxide (as ml/l of a 30% w/w solution) and hydroxylamine compound (as g/l hydroxylamine sulfate) need to be balanced to give the required result.

The photographic material may be first subjected to a development step with a developer solution containing no peroxide or other oxidizing agent before the redox amplification. Alternatively, the development and amplification may be combined in a single step using a combined developer/amplifier solution.

The color photographic material to be processed may be of any type but will preferably contain low amounts of silver halide. Preferred total silver halide coverages are in the range from about 6 to about 300, preferably from about 10 to about 200 mg/m$^2$ and particularly from about 10 to about 100 mg/m$^2$ (as silver).

A particular application of redox amplification is in the processing of silver chloride color paper, for example, paper comprising at least 80 mole % silver chloride, especially such paper with low silver levels, for example, levels below about 200 mg/m$^2$, and preferably below about 100 mg/m$^2$.

The material may comprise the emulsions, sensitizers, couplers, supports, layers, additives, etc. described in *Research Disclosure,* September 1996, Item 38957, published by Kenneth Mason Publications Ltd, Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

According to another aspect of the invention there is provided a process for the redox development of an image-wise exposed photographic material which process comprises developing the photographic material in a redox developer/amplifier solution containing an oxidizing agent and an antioxidant and the process is carried out in a low volume developer tank, and wherein the antioxidant is a mixture of hydroxylamine and an N-substituted hydroxylamine.

As stated above, the process of the invention is particularly suitable for use in a tank of relatively small volume and in a preferred embodiment the ratio of the tank volume to maximum area of material accommodatable therein (i.e., maximum path length times width of material) is less than about 11 dm$^3$/m$^2$, preferably less than about 3 dm$^3$/m$^2$.

The process may be carried out in what is known in the art as a minilab, for example, the tank volume may be below 5 liters and sometimes below 3.0 liters, conveniently in the range from about 1.5 to about 2.5 liters and may be about 1 liter.

The material to be processed is conveniently passed through the tank and preferably the developer solution is recirculated through the tank at a rate of 0.1 to 10 tank volumes per minute. The preferred recirculation rate is from 0.5 to 8 especially from 1 to 5 and particularly from 2 to 4 tank volumes per minute.

The recirculation with or without replenishment may be carried out continuously or intermittently. In one method of working both can be carried out continuously while processing is in progress but not at all or intermittently when the tank is idle.

Replenishment may be carried out by introducing the required amount of replenisher into the recirculation system either inside or outside the processing tank.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less than 11 mm, preferably less than 5 mm and especially about 2 mm.

The shape of the tank is not critical but it may conveniently be in the shape of a shallow tray or, preferably U shaped.

It is preferred that the dimensions of the tank be chosen so that the width of the tank is the same as or only just wider than the width of the material being processed.

The total volume of the processing solution within the processing channel and recirculation system is relatively smaller as compared with prior art processes. In particular the total amount of processing solution in the entire processing system for a particular module is such that the total volume in the processing channel is at least 40% of the total volume of the processing solution in the entire system. Preferably the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A < 23$$

where F is the flow rate of the solution through the nozzle in liters/minute and A is the cross sectional area of the nozzle provided in square centimeters.

Providing a nozzle in accordance with the foregoing relationship assures appropriate discharge of the processing solution against the photosensitive material.

Such low volume thin tank systems are described in more detail in the following patent specifications: U.S. Pat. No. 5,294,956; U.S. Pat. No. 5,179,404; U.S. Pat. No. 5,270,762; EP-A-559,025; EP-A-559,026; EP-A-559,027; WO 92/10790; WO 92/17819; WO 93/04404; WO 92/17370; WO 91/19226; WO 91/12567; WO 9207302; WO 93/00612, WO 92/07301 and U.S. Pat. No. 5,436,118.

According to another aspect of the present invention there is provided a low volume developer tank for use in redox development said tank containing a redox developer/amplifier solution which comprises:

a color developing agent, hydrogen peroxide or a compound which provides hydrogen peroxide and hydroxylamine or a salt thereof and wherein the concentration ranges are:

hydrogen peroxide from about 0.1 to about 20 ml/l (as 30% w/w solution), hydroxylamine or a salt thereof from about 0.10 to about 10 g/l (as hydroxylamine sulfate), and wherein the pH is in the range from about 10.5 to about 12.5.

The invention is illustrated by the following Examples.

EXAMPLE 1

A low silver color paper containing about 58 mg/m$^2$ of silver which was substantially silver chloride was exposed and subjected to a process cycle as follows:

| | |
|---|---|
| develop | 45 seconds |
| fix | 45 seconds |
| wash | 2 minutes |

where the fixer was 50 g/l of sodium sulfite.

A developer solution of the composition shown in Table 1 was made up.

TABLE 1

Developer composition.

| Component | Amount |
|---|---|
| Sequestrant 1 | 0.6 g/l |
| Sequestrant 2 | 0.81 g/l |
| $K_2HPO_4 3H_2O$ | 40 g/l |
| KBr | 1.0 mg/l |
| KCl | 0.5 g/l |
| HAS | 1.0 g/l |
| CDS | 0.3 g/l |
| CD3 | 4.5 g/l |
| pH | 11.4 |
| $H_2O_2$ (30%) | 2 ml/l |

Sequestrant 1 is a 60% aqueous solution of 1-hydroxyethylidene-1,1-diphosphonic acid.

Sequestrant 2 is a 41% aqueous solution of the pentasodium salt of diethylene pentaacetic acid.

CD3 is 4-N-ethyl-(β-methanesulfonamidoethyl)-o-toluidine sesquisulfate

CDS is catechol disulfonate and HAS is hydroxylammonium sulfate.

This developer is the control developer (Dev 1), a second developer (Dev 2) was made by adding 1 ml/l of diethylhydroxylamine (85%), a third (Dev 3) was made by adding 10 ml/l of diethylhydroxylamine (85%) and a fourth (Dev 4) by replacing the HAS in Dev 1 with an equimolar amount of diethylhydroxylamine (1.0 ml/l). These developers were placed in 500 ml measuring cylinders in a water thermostat at 35° C. and monitored from time to time with sensitometric strips. The Dmax values were measured by the well-known sensitometric method which measures the color development using a preexposed test strip and involves measuring the dye Dmax values for red, green and blue. The Dmax densities are shown as a function of time in Table 2.

TABLE 2

Dmax versus time
Dmax neutral × 100

| age | Dev 1 | | | Dev 2 | | | Dev 3 | | | Dev 4 | | |
|---|---|---|---|---|---|---|---|---|---|---|---|---|
| days | R1 | G1 | B1 | R2 | G2 | B2 | R3 | G3 | B3 | R4 | G4 | B4 |
| 0 | 251 | 262 | 267 | 262 | 272 | 282 | 230 | 261 | 270 | 284 | 281 | 275 |
| 1 | 254 | 266 | 271 | 246 | 262 | 268 | 167 | 195 | 203 | 73 | 94 | 97 |
| 3 | 258 | 267 | 266 | 211 | 236 | 246 | 73 | 88 | 92 | | | |
| 7 | 263 | 263 | 251 | 71 | 88 | 99 | 71 | 88 | 92 | | | |

It can be seen that under these static conditions where there is no forced aeration the presence of diethylhydroxylamine is detrimental to the long-term stability and the larger the amount the more detrimental it is.

The combination of HAS and diethylhydroxylamine in Dev 2 is, however, still significantly more stable than diethylhydroxylamine used by itself as in Dev 4. In Dev 4 analysis shows that all the hydrogen peroxide has decomposed after 1 day whereas after 1 day in Dev 2, 80% of the hydrogen peroxide is still present. This result is surprising since it is known that diethylhydroxylamine causes rapid loss of hydrogen peroxide and the same rapid loss of hydrogen peroxide would be expected to happen in Dev 2 as in Dev 4. The presence of hydroxylamine in Dev 2 appears to inhibit the effect of diethylhydroxylamine and lower the peroxide loss. This is entirely unexpected.

Dev 3 shows the effect in a more pronounced manner, this has 10 times the amount of diethylhydroxylamine than has Dev 2 or Dev 4 and yet it still lasts longer than Dev 4.

Thus, a combination of HAS and diethylhydroxylamine can provide a developer that is useable for between 1 and 3 days whereas the developer with diethylhydroxylamine by itself is only useable for a few hours.

EXAMPLE 2

A developer was made up with a composition as shown in Table 3.

TABLE 3

| Developer composition | |
|---|---|
| Component | Amount |
| Sequestrant 1 | 0.6 g/l |
| Sequestrant 2 | 0.81 g/l |
| $K_2HPO_43H_2O$ | 40 g/l |
| KBr | 1.0 mg/l |
| KCl | 0.5 g/l |
| HAS | 1.0 g/l |
| CDS | 0.3 g/l |
| CD3 | 4.5 g/l |
| pH | 11.0 |
| $H_2O_2$ (30%) | 2 ml/l |

This was the control developer (Dev 5) and another developer (Dev 6) was made by adding 1 ml/l of diethylhydroxylamine (85%) to the control developer. These developers were bubbled with compressed air at the same rate using flow meters set to 30 ml/min. At the start and at intervals the bubbling was stopped and sensitometric strips on low silver paper containing 58 mg/m$^2$ of silver were processed according to the process cycle of Example 1. The results are shown in Table 4.

TABLE 4

| Dmax (Neutral) versus Aeration time | | | | | | |
|---|---|---|---|---|---|---|
| | Dmax × 100 | | | | | |
| Aeration time | Dev 5 | | | Dev 6 | | |
| hours | R5 | G5 | B5 | R6 | G6 | B6 |
| 0 | 250 | 254 | 253 | 245 | 251 | 252 |
| 3 | 250 | 255 | 240 | 256 | 255 | 249 |
| 5.5 | 204 | 233 | 216 | 247 | 254 | 238 |

TABLE 4-continued

| Dmax (Neutral) versus Aeration time | | | | | | |
|---|---|---|---|---|---|---|
| | Dmax × 100 | | | | | |
| Aeration time | Dev 5 | | | Dev 6 | | |
| hours | R5 | G5 | B5 | R6 | G6 | B6 |
| aeration stopped | | | | | | |
| 3 days without aeration | 127 | 149 | 182 | 67 | 75 | 89 |

Thus it can be seen that the presence of diethylhydroxylamine is beneficial when strong aeration is carried out at least for periods up to 5.5 hours. It can also be seen that after aeration is stopped the developer containing diethylhydroxylamine is less stable than the control; although this is relatively unimportant since neither developer is useable at this stage. After 5.5 hours aeration developer 6 is still fully useable whereas developer 5 is unusable. Thus a combination of antioxidants can provide a compromise position of a developer that is useable over a number of days under low aeration conditions but is also useable under high aeration conditions. This is not possible with a single antioxidant such as diethylhydroxylamine since the developer degrades rapidly even without aeration or with a single antioxidant such as hydroxylamine since although stable under low aeration conditions it degrades rapidly with high aeration.

EXAMPLE 3

In this example the level of diethylhydroxylamine added to the developer is lowered to the point at which there is no significant effect on the standing stability under conditions of low aeration but there is still a benefit under conditions of high aeration.

The developer composition is shown in Table 5.

TABLE 5

| Developer composition | |
|---|---|
| Component | Amount |
| Sequestrant 1 | 0.6 g/l |
| Sequestrant 2 | 0.81 g/l |
| $K_2HPO_43H_2O$ | 40 g/l |
| KBr | 1.5 mg/l |
| KCl | 0.5 g/l |
| HAS | 1.2 g/l |
| CDS | 0.3 g/l |
| CD3 | 5.5 g/l |
| pH | 11.5 |
| $H_2O_2$ (30%) | 2.5 ml/l |

This was Dev 7 and Dev 8 with 0.3 ml/l of diethylhydroxylamine added. The results are shown in Table 6.

TABLE 6

Dmax (neutral) versus developer age

| age | Dmax × 100 | | | | | |
|---|---|---|---|---|---|---|
| | Dev 7 | | | Dev 8 | | |
| (hours) | R7 | G7 | B7 | R8 | G8 | B8 |
| 0 | 270 | 270 | 241 | 266 | 268 | 238 |
| 66 | 273 | 271 | 242 | 267 | 264 | 238 |
| 74 | 269 | 269 | 239 | 268 | 269 | 235 |
| 98 | 260 | 263 | 227 | 257 | 262 | 229 |
| 106 | 264 | 264 | 229 | 260 | 263 | 232 |
| 130 | 257 | 262 | 227 | 256 | 258 | 226 |

These data show that with a relatively small amount of diethylhydroxylamine added to the developer which contains HAS as the main antioxidant the losses on standing in static conditions are not any different from those without any diethylhydroxylamine.

An aeration experiment was carried out in the same way as in Example 2 but using developers 7 and 8; the results are shown in Table 7.

TABLE 7

Dmax (neutral) versus aeration time

| aeration time | Dmax × 100 | | | | | |
|---|---|---|---|---|---|---|
| | Dev 7 | | | dev 8 | | |
| (hours) | R7 | G7 | B7 | R8 | G8 | B8 |
| 0 | 270 | 269 | 238 | 268 | 269 | 238 |
| 3 | 269 | 264 | 228 | 266 | 267 | 236 |
| 5.5 | 222 | 242 | 201 | 251 | 259 | 227 |

These data show that a relatively small amount of diethylhydroxylamine improves the resistance of the developer to aerial oxidation but does not impair the standing ability under static conditions.

The advantage of the present invention is that for processes carried out with roller transport machines or involving high aeration such as those with partially submerged rollers and with high or continuous recirculation of developer solution, the stability of the solution is improved.

The invention has been described in detail with particular reference to certain preferred embodiments thereof, but it will be understood that variations and modifications can be effected within the spirit and scope of the invention.

I claim:

1. A developer/amplifier solution for use in redox development comprising:

a colour developing agent, as oxidising agent hydrogen peroxide or a compound which provides hydrogen peroxide and as antioxidant hydroxylamine and, to improve the stability of the solution under aeration conditions, an effective amount of a mono or di N-substituted hydroxylamine wherein substituents in the mono- or di-N-substituted hydroxylamine are monovalent organic groups containing 1 to 12 carbon atoms and the molar ratio of hydroxylamine to N-substituted hydroxylamine is from 1:200 to 100:1.

2. The developer/amplifier solution of claim 1 wherein the molar ratio of hydroxylamine to said mono- or di-N-substituted hydroxylamine is from from 1:10 to 10:1.

3. The developer/amplifier solution of claim 1 wherein said organic groups are alkyl or aryl groups that can be substituted with sulfo, hydroxy, carboxy, carbonamido or sulfonamido.

4. The developer/amplifier solution of claim 3 wherein the groups are $C_1$ to $C_6$ alkyl groups.

5. The developer/amplifier solution of claim 1 wherein hydrogen peroxide is present at from 0.1 to 20 ml/l (as 30% w/w aqueous solution), hydroxylamine or a salt thereof is present at from 0.25 to 8 g/l, and said mono- or di-N-substituted hydroxylamine is present at from 0.001 to 0.2 molar, and wherein the pH of the solution is from 10.5 to 12.5.

6. The low volume developer tank for use in redox development, said tank containing a redox developer/amplifier solution which comprises:

a color developing agent, hydrogen peroxide or a compound which provides hydrogen peroxide, hydroxylamine or salt thereof, and a mono- or di-substituted hydroxylamine, wherein hydrogen peroxide is present at from 0.5 to 20 ml/l (as 30% w/w aqueous solution), hydroxylamine or a salt thereof is present at 0.1 g/l to 10 g/l (as hydroxylamine sulfate), and said mono- or di-N-substituted hydroxylamine is present at from 0.001 ml/l to 0.2 molar, and wherein the pH is in the range from 10.5 to 12.5.

7. The low volume developer tank of claim 6 wherein the molar ratio of hydroxylamine to said mono- or di-N-substituted hydroxylamine is from 1:200 to 100:1.

8. The low volume developer tank of claim 7 wherein the molar ratio of hydroxylamine to said mono- or di-N-substituted hydroxylamine is from from 1:10 to 10:1.

9. The process for the redox development of an imagewise exposed photographic recording material, said process comprising developing said photographic recording material with a redox developer/amplifier solution comprising:

a color developing agent, as oxidizing agent, hydrogen peroxide or a compound which provides hydrogen peroxide, hydroxylamine or salt thereof and, an effective amount of a mono- or di-N-substituted hydroxylamine as a solution stabilizer.

10. The process of claim 9 carried out with partially submerged rollers with continuous recirculation of said developer solution.

11. The process of claim 9 carried out in a low volume developer tank.

12. The developer/amplifier solution of claim 1 wherein the molar ratio of hydroxylamine to N-substituted hydroxylamine is from 1:2 to 5:1.

13. The developer/amplifier solution of claim 1 having a pH of from about 11 to about 11.7.

14. The developer/amplifier solution of claim 13 having a pH of from about 11 to about 11.4.

* * * * *